US009016611B2

(12) United States Patent
Tosaka et al.

(10) Patent No.: US 9,016,611 B2
(45) Date of Patent: Apr. 28, 2015

(54) MEDIUM STORING AND ADVANCING APPARATUS

(75) Inventors: Yoshiyuki Tosaka, Gunma (JP); Kentaro Kamagata, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 790 days.

(21) Appl. No.: 12/737,064

(22) PCT Filed: May 21, 2009

(86) PCT No.: PCT/JP2009/059354

§ 371 (c)(1),
(2), (4) Date: Dec. 6, 2010

(87) PCT Pub. No.: WO2009/157264

PCT Pub. Date: Dec. 30, 2009

(65) Prior Publication Data

US 2011/0073611 A1 Mar. 31, 2011

(30) Foreign Application Priority Data

Jun. 24, 2008 (JP) ..... 2008-165122

(51) Int. Cl.
*B65H 39/14* (2006.01)
*B65H 75/44* (2006.01)
(Continued)

(52) U.S. Cl.
CPC ..... *B65H 75/4428* (2013.01); *B65H 29/006* (2013.01); *B65H 43/08* (2013.01); *B65H 2301/41912* (2013.01); *B65H 2403/72* (2013.01); *B65H 2403/732* (2013.01); *B65H 2701/1912* (2013.01); *B65H 2701/37* (2013.01)

(58) Field of Classification Search
CPC .... B65H 5/023; B65H 29/12; B65H 75/4428; B65H 2301/41912; B65H 2701/1912; G11B 15/06
USPC ..... 242/528, 396, 396.1, 396.2, 396.4; 271/3.14, 216
See application file for complete search history.

(56) References Cited

U.S. PATENT DOCUMENTS 1,254,631 A * 1/1918 Shepard ..... 254/271
2,954,940 A * 10/1960 Herrmann ..... 242/333
(Continued)

FOREIGN PATENT DOCUMENTS

CN 1573820 A 2/2005
EP 0290731 A2 11/1988
(Continued)

OTHER PUBLICATIONS

Chinese Office Action dated Nov. 5, 2012 with English translation.

*Primary Examiner* — Sang Kim
*Assistant Examiner* — Justin Stefanon
(74) *Attorney, Agent, or Firm* — Rabin & Berdo, P.C.

(57) ABSTRACT

To provide a medium storing and advancing apparatus for inhibiting rotation of a drum when tapes are completely rewound from the drum. The apparatus includes reels supplying and winding up the tapes, a drum winding up the tapes supplied from the reels or rewinding wound-up tapes to supply the tapes to the reels, and an inhibiting mechanism inhibiting further rotation of the drum in a direction of rewinding the tapes when the drum completely rewinds the tapes, whereby the inhibiting mechanism inhibits the rotation of the drum.

14 Claims, 9 Drawing Sheets

(51) Int. Cl.
*B65H 29/00* (2006.01)
*B65H 43/08* (2006.01)

(56) References Cited

U.S. PATENT DOCUMENTS

| | | | | | |
|---|---|---|---|---|---|
| 3,051,405 | A * | 8/1962 | Lyon | 242/333.2 |
| 3,625,450 | A * | 12/1971 | Lloyd, Jr. | 242/396.2 |
| 3,632,052 | A * | 1/1972 | Read | 242/534.2 |
| 3,659,804 | A * | 5/1972 | Roman | 242/332.8 |
| 3,715,087 | A * | 2/1973 | Schmidt | 242/528 |
| 3,903,795 | A * | 9/1975 | Suzuki | 101/409 |
| 4,179,211 | A * | 12/1979 | Kimura et al. | 399/21 |
| 4,183,652 | A * | 1/1980 | Yanagawa | 399/117 |
| 4,496,142 | A * | 1/1985 | Iwasaki | 271/3.03 |
| 4,513,880 | A * | 4/1985 | Mori et al. | 221/260 |
| 4,928,901 | A * | 5/1990 | Bannai et al. | 242/396 |
| 6,520,446 | B2 * | 2/2003 | Eugster | 242/528 |
| 6,585,098 | B2 * | 7/2003 | Satou et al. | 194/206 |
| 7,494,122 | B2 * | 2/2009 | Spinetti | 271/216 |
| 8,215,579 | B2 * | 7/2012 | Mizoro | 242/528 |
| 8,561,980 | B2 * | 10/2013 | Demmeler et al. | 271/124 |
| 2005/0017428 | A1 | 1/2005 | Ichikawa et al. | |
| 2006/0097444 | A1 * | 5/2006 | Spinetti | 271/216 |
| 2006/0225986 | A1 * | 10/2006 | Oishi et al. | 194/203 |
| 2007/0221776 | A1 * | 9/2007 | Rossel et al. | 242/528 |
| 2008/0149660 | A1 * | 6/2008 | Zwahlen | 221/70 |
| 2010/0100245 | A1 * | 4/2010 | Oishi et al. | 700/275 |

FOREIGN PATENT DOCUMENTS

| | | | | |
|---|---|---|---|---|
| JP | 08-067382 | A | 3/1996 | |
| JP | 2006069708 | A * | 3/2006 | B65H 29/51 |
| WO | WO-0125127 | A1 | 4/2001 | |
| WO | WO2013140686 | A1 * | 9/2013 | G07D 9/00 |

* cited by examiner

MEDIUM STORING AND ADVANCING APPARATUS

TECHNICAL FIELD

The present invention relates to a medium storing and advancing apparatus which stores and advances a medium such as a bill, a check, or securities by winding up and rewinding tapes wound on a drum and reels, and more particularly to a bill depositing and withdrawing machine, a check/securities retrieving and issuing machine, or a bill/check/securities receiving and delivering apparatus.

BACKGROUND ART

The conventional medium storing and advancing apparatus includes, for example, as disclosed in Japanese Patent Laid-Open Publication No. 67382/1996, reels which supply and wind up tapes and a drum which winds up the tapes supplied from the reels, wherein, a bill, when being stored, coming through a bill insertion and discharge slot is sandwiched between two lengths of tapes, which have the ends thereof attached to the drum, which is rotated in a direction winding up the tapes, thereby winding up the bill on the drum together with the tapes to store the bill. Therefore, the tapes are wound on the drum with the single portions being attached to the drum.

When thus wound-up tapes are rewound from the drum and are wound up by the reels, if tape end sensors are provided in the medium storing and advancing apparatus, the tape end sensors sense that the tapes are rewound from the drum by a predetermined length, thereby stopping rotations of the drum and the reels.

However, in the above-described conventional solution, under the condition that the tape end sensors malfunction, if the tapes are rewound from the drum and wound up by the reels, the drum and the reels continue to rotate, even if the tapes are rewound from the drum by a predetermined length, so that the tapes are completely rewound from the drum, thus a problem arising that the rotations of the drum and the reels cause the tapes to be pulled and thereby cut.

A similar problem may occur when a person in charge performs rewinding manipulation to manually rotate the drum in order to take out a bill when, for example, jammed on the drum.

SUMMARY OF THE INVENTION

It is an object of the present invention to overcome the drawbacks of the prior art described above and to provide a medium storing and advancing apparatus that prevents further rotation of the drum in a direction of rewinding the tapes when the tapes are completely rewound from the drum.

The medium storing and advancing apparatus according to the present invention includes an inhibiting mechanism which inhibits further rotation of the drum in a direction of rewinding tapes when the tapes are completely rewound from the drum. The inhibiting mechanism will engage with the drum whenever the drum completely rewinds the tapes, thereby inhibiting rotation of the drum.

Therefore, in accordance with the present invention, even if the tape end sensors malfunction, rotation of the drum can be prevented by the inhibiting mechanism when the tapes are completely rewound from the drum, thus making it possible to prevent the tapes from being destroyed by rewinding of the drum. It is easy to mount the inhibiting mechanism because of its simple constitution, and also costs required to the inhibiting mechanism can be minimized.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

Embodiments of a medium storing and advancing apparatus 10 according to the present invention will be described in detail with reference to the accompanying drawings.

Figure 1:
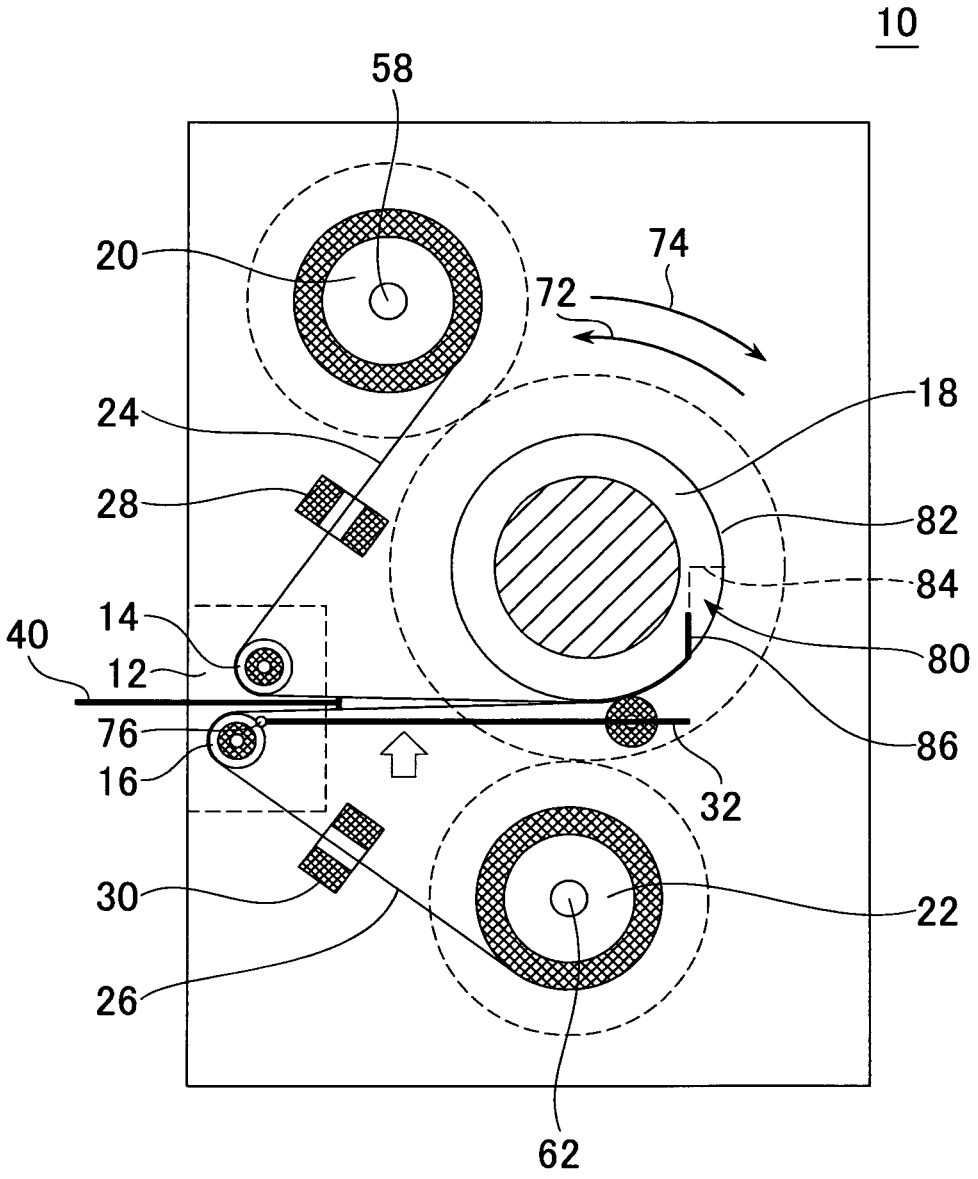
FIG. 1 is a schematic side view showing the main part of an embodiment of a medium storing and advancing apparatus according to the present invention.
Figure 2:
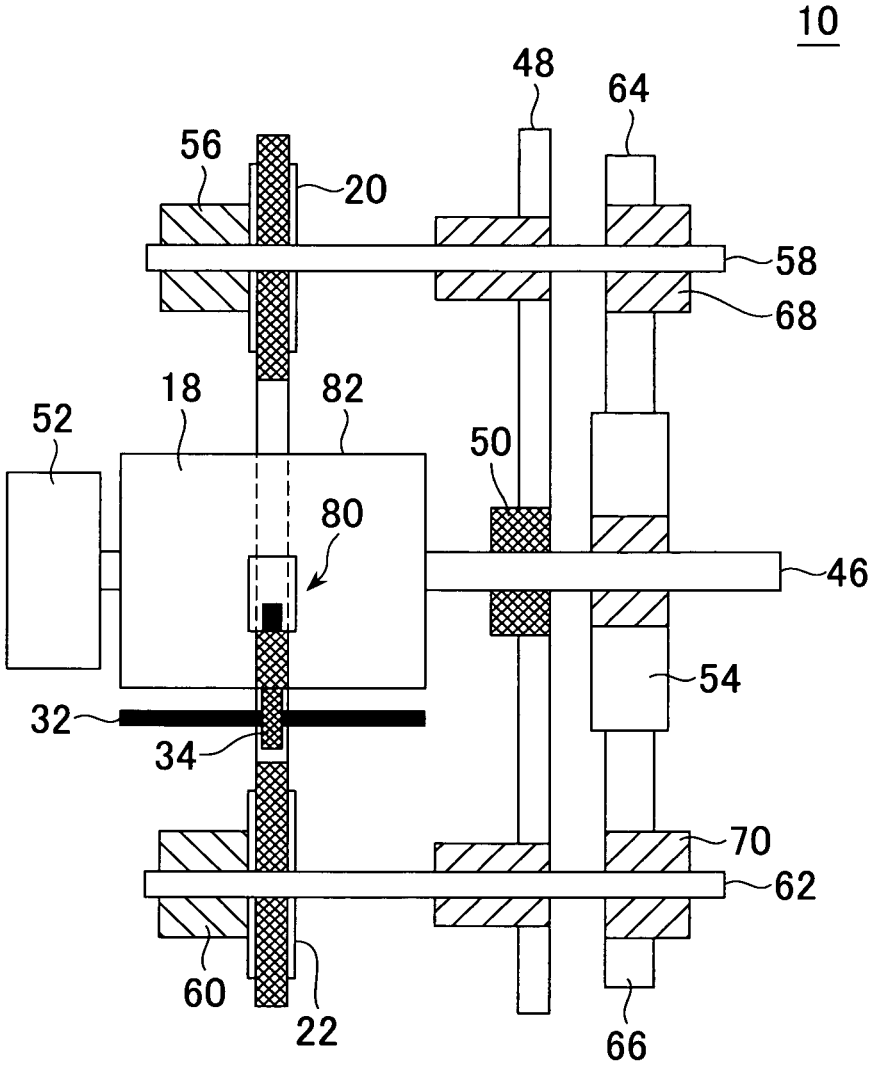
FIG. 2 is a schematic front sectional view showing the main part of the embodiment of the medium storing and advancing apparatus according to the present invention.

In FIGS. 1 and 2, the main part of an embodiment of a medium storing and advancing apparatus according to the present invention is schematically shown from a side and a front direction, respectively. In FIG. 2, the same reference numerals as in FIG. 1 denote like structural elements, of which repetitive descriptions will be omitted. In the embodiments shown in FIGS. 1 and 2, the medium storing and advancing apparatus 10 is adapted to store and advance a bill conveyed to the medium storing and advancing apparatus 10 by, for example, a conveyor unit or the like. As shown in FIG. 1, the apparatus 10 includes a bill insertion and discharge slot 12, idlers 14 and 16, a drum 18, a reel 20 disposed above the drum 18, a reel 22 disposed under the drum 18, tapes 24 and 26 to be wound up by the drum 18 or the reels 20 and 22, respectively, tape end sensors 28 and 30, a movable guide 32, and a driven roller 34. A medium, i.e. a bill 18 in the present embodiment, sandwiched between the tapes 24 and 26 is stored by winding up by the drum 18 together with the tapes 24 and 26, and the bill 40 is fed out by rewinding the drum 18 and winding up the tapes 24 and 26 with the reels 20 and 22.

The bill insertion and discharge slot 12 is adapted to receive a bill 40 conveyed from a conveyor unit, not shown, outside the medium storing and advancing apparatus, or discharge the bill 40 to the conveyor unit. The idlers 14 and 16 are disposed in the vicinity of the bill insertion and discharge slot 12. Specifically, the idler 14 is disposed between the drum 18 and the reel 20 disposed above the drum 18, and the idler 16 is disposed between the drum 18 and the reel 22 disposed under the drum 18. Via these idlers 14 and 16, the tapes 24 and 26 respectively move from the drum 18 to the reels 20 and 22. Therefore, the bill 40 conveyed from the bill insertion and discharge slot 12 is, as shown in FIG. 1, inserted between the idlers 14 and 16, i.e. between the tapes 24 and 26, or discharged from between the tapes 24 and 26.

The drum 18 is adapted to store or feed out, while rotating, a bill by winding or rewinding the tapes 24 and 26. Specifically, the tapes 24 and 26 move, while the drum 18 rotates, to feed the bill received from the insertion and discharge slot 12 to the drum 18 together with the tapes 24 and 26. By rotation of the drum 18 in the direction opposite the winding direction, the bill 40 stored in the apparatus 10 is conveyed to the bill insertion and discharge slot 12.

As shown in FIG. 2, the drum 18 includes a drum shaft 46, which rotates by, for example, a drive motor, not shown, to serves as a rotation axis of the drum 18. In the embodiment shown in FIG. 2, the drum shaft 46 is attached to a frame 48 of the medium storing and advancing apparatus 10 via a bearing 50 so that the drum shaft 46 is rotatable with respect to the frame 48.

The drum shaft 46 has an operation knob 52 fixed thereto so that an operator or the like can manually turn the operation knob 54 to cause the drum 18 to rotate together with the drum shaft 46. Further, the drum shaft 46 is equipped with a drum gear 52, which transmits the rotation of the drum shaft 46 to the reels 20 and 22.

The reels 20 and 22 are adapted to wind up the tapes 24 and 26 from the drum 18 while the drum shaft 46 rotates. As shown in FIG. 2, the reels 20 and 22 are equipped with reel shafts 58 and 62 via torque limiters 56 and 60, respectively, and the reel shafts 58 and 62 are attached to the frame 48.

The reel shafts 58 and 62 are equipped with reel gears 64 and 66, respectively, which engage with the drum gear 54. The reel gears 64 and 66 are respectively attached to the reel shafts 58 and 62 via one-way clutches 68 and 70, which respectively function as transmitting the rotation in predetermined directions of the reel gears 64 and 66 to the reel shafts 58 and 62. Since the reel gears 64 and 66 engage with the drum gear 52, the rotation of the drum shaft 46, causing the drum gear 54 to rotate, will thereby be transmitted to the reel gears 64 and 66 while the drum gear 54 rotates. However, the rotation transmitted from the drum gear 54 to the reel gears 64 and 66 may sometimes not be transmitted to the reel shafts 58 and 62 by the one-way clutches 68 and 70, respectively.

Describing more specifically, in the case where the rotation of the drum shaft 46 causes the drum 18 to rotate in the direction of winding up the tapes 24 and 26, i.e. a direction shown by an arrow 72 in FIG. 1, the rotation of the drum shaft 46 is transmitted from the drum gear 54 to the reel gears 64 and 66, whereas the one-way clutches 68 and 70 run idle so as not to rotate the reel shafts 58 and 62.

By contrast, in the case where the rotation of the drum shaft causes the drum 18 to rotate in the direction of rewinding the tapes 24 and 26, i.e. a direction shown by an arrow 74 in FIG. 1, the rotation is transmitted from the drum gear 54 to the reel shafts 58 and 62 via the reel gears 64 and 66 so as to rotate the reel shafts 58 and 62, thereby the reels 20 and 22 rotating in the direction of winding up the tapes 24 and 26. In the present embodiment, the direction 72 of winding up the tapes 24 and 26 by the drum 18 is counterclockwise, while the direction 74 of rewinding the tapes 24 and 26 by the drum 18 is clockwise.

The tapes 24 and 26 have a function of sandwiching the bill 40 therebetween to be wound up by the drum 18, thereby storing the bill, and rewinding the bill by the drum 18, thereby discharging the bill 40 from therebetween. The tape 24 has its one end portion wound on the drum 18 and its other end portion wound on the reel 20 via the idler 14. In the same way, the tape 26 has its one end portion wound on the drum 18 and its other end portion wound on the reel 22 via the idler 16.

In the present embodiment, the tapes 24 and 26 of the embodiment are transparent to transmit light. Meanwhile, the tape 24 has its predetermined length of each end portion colored for shielding light on the side to be wound on the drum 18 to form a light shielding part, the predetermined length corresponding, for example, to 100 rounds by which the tape is allowed to be wound. In the same way, the tape 26 has its predetermined length of each end portion colored for shielding light on the side to be wound on the reel 22 to form a light shielding part.

The tape end sensors 28 and 30 are adapted for figuring out how much the tapes 24 and 26 are wound on the drum 18 and the reels 20 and 22. In the present embodiment, the sensors 28 and 30 are respectively arrayed at a position in the vicinity of the reels 20 and 22 so as not to touch the tapes 24 and 26. The sensors 28 and 30 are optical sensors, and respectively include a light emitter and a light sensor, not shown, and the tapes 24 and 26 pass through between the light emitter and the light sensor. As described above, in the present embodiment, since the light shielding part is formed in the vicinity of each end portion of the tapes 24 and 26, the sensors 28 and 30 sense the light shielding part of the tapes 24 and 26 to thereby detect each end portion of the tapes 24 and 26.

More specifically, the sensor 28 senses that the tape 24 wound on the drum 18 is running out, i.e. the tail end portion of the tape 24 is close when the light sensor of the sensor 28 fails to receive light from its light emitter shielded by the light shielding part of the tape 24. In the same way, the sensor 30 senses that the tape 26 wound on the reel 22 is running out when the light sensor of the sensor 30 fails to receive light from its light emitter by the light shielding part of the tape 26. When the tape end sensors 28 and 30 respectively detect the end portions of the tapes 22 and 24, the medium storing and advancing apparatus 10 grasp how much the tapes 24 and 26 are wound up on the drum 18 of the reels 20 and 22 to control the rotation thereof.

Figure 3:
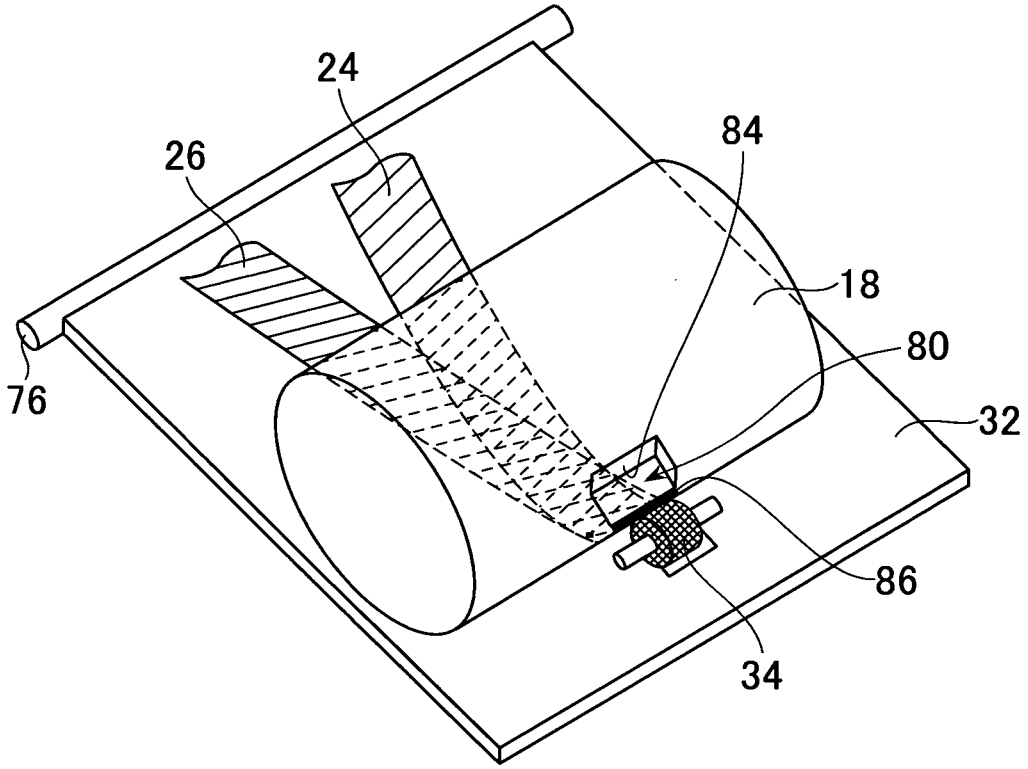
FIG. 3 is an explanatory diagram schematically showing a positional relationship between the drum and the movable guide in the embodiment of FIG. 1.

As shown in FIG. 3, the movable guide 32 is arrayed under the drum to guide the lower part of the medium 40 that moves from the bill insertion and discharge slot 12 to the drum 18. The movable guide 32 has a spring property by being equipped with a spring material, not shown, such as a flat spring so that a biasing force is applied upward to the movable guide 32, i.e. toward the drum 18, and a rotary shaft 76 is provided at one end of the movable guide 32. Therefore, when the tape's 24 and 26 are wound on the drum 18, the movable guide 32 pivots by a distance equal to the thickness of tapes 24 and 26 about the rotary shaft 76. In the vicinity of the other end of the movable guide 32, a single driven roller 34 is mounted which is disposed so as to protrude toward the drum 18 with respect to the movable guide 32, thereby facing the outer peripheral surface of the drum 18.

When the drum 18 starts to rotate, the driven roller 34 is depressed against the drum 18 by the biasing force of the movable guide 32 and rotates by the pivotal movement of the rotary shaft 76 while the drum 18 rotates. When the tapes 24 and 26 are wound on the drum 18, as shown in FIG. 3, the roller will run over the wound tapes 24 and 26 and rotates while being in contact with the tapes 24 and 26.

The surface of the drum 18 has a rotation stoppage recess 80 formed at a portion where the surface contacts the driven roller 34. The recess 80 is formed to have its width larger than the width of the driven roller 34, so that the driven roller 34 can be received by the recess 80. The driven roller 34 is brought into mate with the recess when the drum 18 on which the tapes 24 and 26 are not wound is rotated in the direction of rewinding the tapes 74 in order to prevent the rotation of the drum 18.

In the present embodiment, the rotation stoppage recess 80 is formed such that the outer peripheral surface 82 of the drum 18 is partially cut into an L shape as illustrated in FIGS. 1 and 3, and includes a vertical surface 84 and a tape bonding surface 86. The vertical surface 84 is approximately vertical with respect to the outer peripheral surface 82 of the drum, i.e. is formed so as to be cut into the radial direction of the drum 18. The driven roller 34 abuts on the vertical surface 84 to be hooked on the surface 84. As a result thereof, the driven roller 34 is seated in the recess 80. The tape bonding surface 86 is formed by cutting such that the tape bonding surface 86 has a right angle with respect to the vertical surface 84 and a direction from the vertical surface 84 to the outer peripheral surface 82 of the drum becomes the same as the direction of rewinding the tapes 74. Each of the tapes 24 and 26 has its one end portion bonded to the tape bonding surface 86. When the drum 18 is rotated in a tape wind-up direction 72, the tapes 24 and 26 are wound on the drum 18 while covering the recess 80.

Figure 4:
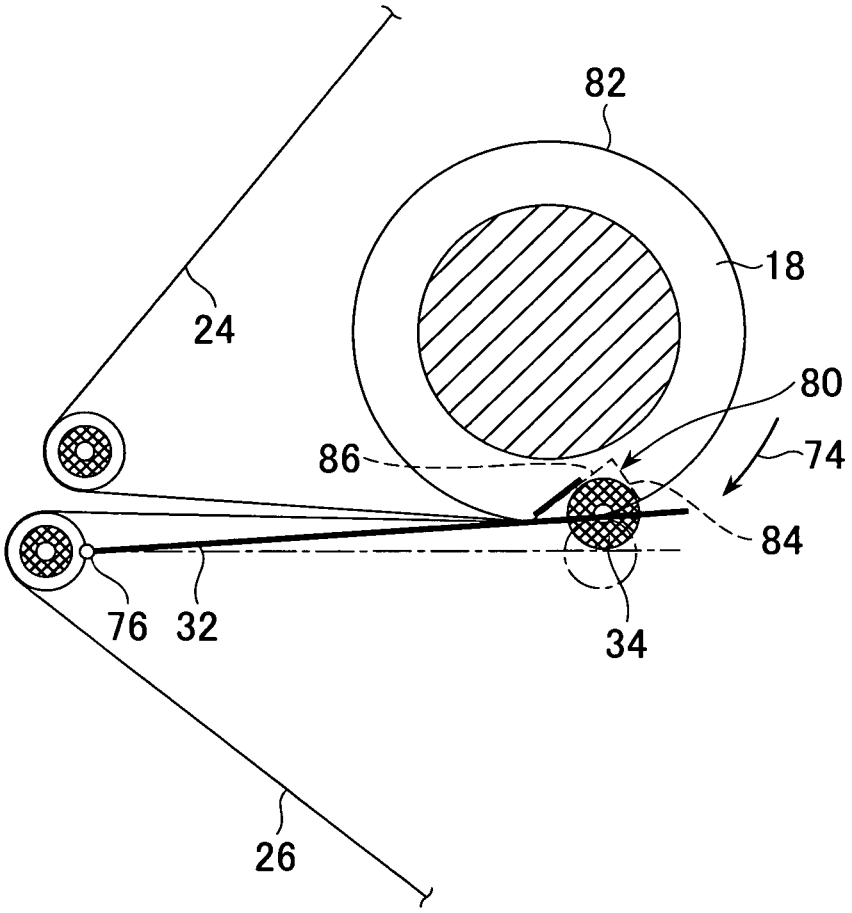
FIG. 4 is a schematic side view showing how the rotation of the drum is inhibited by an inhibiting mechanism in the embodiment of FIG. 1.
Figure 5:
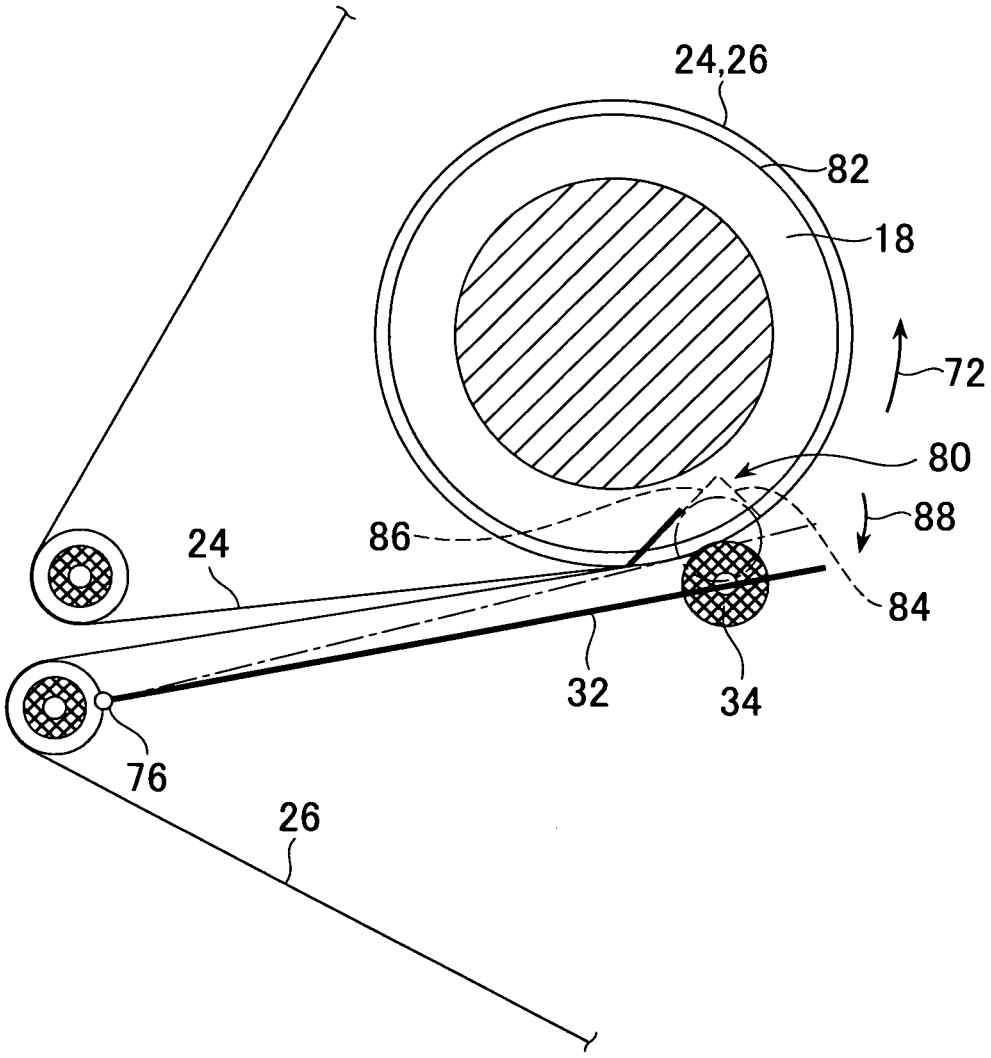
FIG. 5 is a schematic side view showing how the drum in the embodiment of FIG. 1 is rotated.

Prevention of the rotation of the drum 18 caused by the engagement of the driven roller 34 with the rotation stoppage recess 80 will be described in detail with reference to FIG. 4. When the drum 18 on which the tapes 24 and 26 are not wound is rotated in the tape rewinding direction 74, the driven roller 34 falls onto the rotation stoppage recess 80 to abut on the vertical surface 84 to be engaged with the rotation stoppage recess 80 as illustrated in FIG. 4. As described above, in the present embodiment, the driven roller 34 abuts on the vertical surface 84 to cause the driven roller 34 to be engaged with the rotation stoppage recess 80, so that the driven roller 34 engaged with the rotation stoppage recess 80 can inhibit the rotation of the drum 18.

As described above, in the present embodiment, the driven roller 23 and the rotation stoppage recess 80 form an inhibiting mechanism which inhibits, when the tapes 24 and 26 are completely rewound, the drum 18 from being continuously rotated in the direction of rewinding the tapes 74. In the present embodiment, when the drum 18 is rotated in the tape rewinding direction 74, the driven roller 34 is hooked against the vertical surface 84 to be engaged with the rotation stoppage recess 80, thereby inhibiting the rotation of the drum 18. Therefore, the depth of the rotation stoppage recess 80, and hence the vertical surface 84 of the rotation stoppage recess 80, is preferably sized to the extent that the driven roller 34 does not climb over the rotation stoppage recess 80. For example, the vertical surface 84 may preferably have its length in the radial direction of the drum 18 equal to or more than the radius of the driven roller 34.

By contrast, when the drum 18 on which the tapes 24 and 26 are not wound is rotated in the tape wind-up direction 72, the driven roller 23 does not hook against the vertical surface 84, even when the driven roller 23 falls into the rotation stoppage recess 80, but passes the tape bonding surface 84 to the outer peripheral surface 82 of the drum. Thus, when the drum 18 is rotated in the tape wind-up direction 72, the driven roller 23 and the rotation stoppage recess 80 would not inhibit the rotation of the drum 18. If the drum 18 further rotates, the tapes 24 and 26 are wound on the drum 18 to cover the rotation stoppage recess 80. Therefore, when the driven roller 23 passes over the rotation stoppage recess 80, the driven roller 34 will come to pass over the tapes 24 and 26 covering the rotation stoppage recess 80. At the same time, the thicknesses of the wound-up tapes 24 and 26 will cause the movable guide 32 to rotate about the rotary shaft 76 so as to be pushed downward as illustrated by an arrow 88. Hence, the tapes 24 and 26 can be wound up in substantially the same manner as the drum 18 which would otherwise not be provided with the rotation stoppage recess 80.

Such an inhibiting mechanism including the driven roller 34 and the rotation stoppage recess 80 can be used in a case of starting the rewind of the tapes 24 and 26 when, for example, the bill 40 sandwiched between the two tapes 24 and 26 is being wound on the drum 18 to be stored on the drum 18. The rewinding operation while the bill 40 is being stored was a factor of causing, for example, a bill to be folded while being stored so as to render a malfunction of the drum 18, i.e. so-called jammed storage. Therefore, the rewinding operation is performed in order to remove the jammed bill to the outside in an exemplary fashion as will be described.

In order to remove the bill causing the jammed storage, a person in charge of the medium storing and advancing apparatus 10 turns the operation knob 52 of the apparatus 10 in the direction of rewinding the tapes. When the operation knob 20 is rotated in the direction of rewinding the tapes, the drum shaft 46 rotates in the direction of rewinding the tapes and thereby the drum 18 is rotated in the direction of rewinding the tapes to rewind the tapes 24 and 26 wound on the drum 18.

Since the drum shaft 46 rotates in the direction of rewinding the tapes while the drum 18 rotates, the rotation is transmitted to the reel gears 64 and 66 from the drum gear 54 mounted on the drum shaft 46. Therefore, the reel shafts 58 and 62 are rotated in the direction of winding up the tapes 24 and 26. Accordingly, the reels 20 and 22 are rotated in the tape wind-up direction to wind up each of the tapes 24 and 26 rewound from the drum 18. As described above, the rotation of the operation knob 52 causes the bill having caused the jammed storage to be fed out together with the tapes 24 and 26 rewound from the drum 18. In turn, the bill will be discharged through the bill insertion and discharge slot 12.

Then, even if the person in charge continues to rotate the operation knob 52, the rotation stoppage recess 80 appears from the beneath of the tapes 24 and 26 wound on the drum 18, so that the driven roller 34 of the movable guide 32 abutting against the drum 18 falls into the rotation stoppage recess 80 to be hooked against the vertical surface 84 of the rotation stoppage recess 80, thereby being engaged with the rotation stoppage recess 80. Thus, the rotation of the drum 18 can be inhibited.

As a matter of course, the inhibiting mechanism can also be used not only in the case where the drum 18 is rotated by the operation knob 52 but also a case where the drum 18 is rotated by means of, e.g. a drive motor, not shown. For example, even in a case where the tape end sensors 28 and 30 malfunction when the drum 18 is rotated in the direction of rewinding the tapes by the drive motor, the rotation stoppage recess 80, when appearing in response to the tapes 24 and 26 being rewound from the drum 18, will engage with the driven roller 34, thus rendering the rotation of the drum 18 to be inhibited.

As described above, in the present embodiment, because of the rotation stoppage recess 80 provided on the drum 18, even when the drum 18 is forced to rotate upon the tapes 24 and 26 being completely rewound from the drum 18, the driven roller 34 is engaged with the rotation stoppage recess 80, so that the drum 18 can be prevented from continuing to rotate. Therefore, also in a case where the person in charge continues to turn the operation knob without awaring that the tapes have completely rewound in order to remove the bill having caused the jammed storage, or in a case where the tape end sensors 28 and 30 malfunction, for example, the tapes 24 and 26 attached to the drum 18 are prevented from being destroyed.

Furthermore, conventionally, at a time of starting to store the bill, the tapes 24 and 26 would preliminary be wound on the drum 18 by plural; e.g. 100, entire loops, around the drum 18 so as to ensure a sufficient margin on the tapes 24 and 26 against an amount by which the tapes 24 and 26 are rewound from the drum 18. In the present invention, however, the rotation stoppage recess 80 and the driven roller 34 are engaged to each other so that the rotation of the drum 18 is inhibited, thereby preventing the tapes 24 and 26 from being destroyed. Therefore, the portion of the tapes preliminary wound on the drum 18 can be made shorter, resulting in achieving cost reduction. If the portion of the tapes preliminary wound on the drum 18 is made shorter, the tapes will be wound on the reels in a smaller amount, thus rendering the reels smaller in diameter and thereby accomplishing a smaller sized medium storing and feeding apparatus.

An alternative embodiment of the medium storing and feeding apparatus of the present invention will be described with reference to FIG. 6. A medium storing and feeding apparatus 100 illustrated in FIG. 6 has substantially the same configuration as the medium storing and feeding apparatus 10 except that the medium storing and feeding apparatus 100 includes a limiter 110 instead of the rotation stoppage recess 80 and that a portion of the movable guide 32 is cut to form a notch 102, instead of the driven roller 34.

The limiter 110 includes a storage 112 and a mating piece 114, which is arranged to be brought into contact with a notch 102 of the movable guide 32 to inhibit the drum 18 from being continuously rotated in the direction of rewinding the tapes 74.

Figure 8:
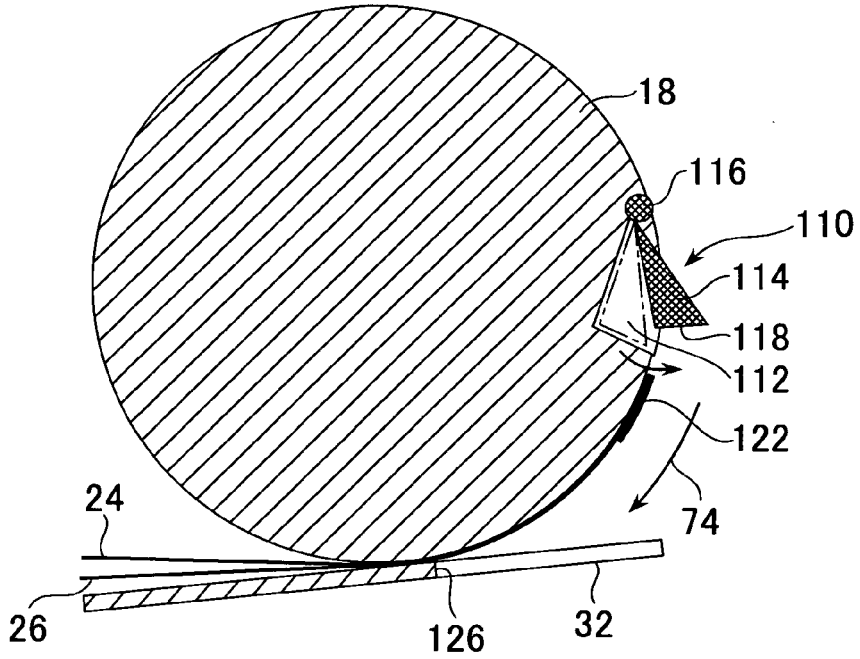
FIG. 8 is a schematic side view showing how the drum in the embodiment of FIG. 6 is rotated in a winding up direction.

The storage 112 is a recess formed in the outer peripheral surface 82 of the drum 18 so as to receive the mating piece 114 thereinto. Therefore, the shape and size of the storage 112 are defined according to the shape and size of the mating piece 114. In the present embodiment, the storage 112 is a recess having substantially the same shape and size as the mating piece 114 as illustrated in FIG. 8 and allows the mating piece 114 in its entirety to seat therein.

The mating piece 114 is arranged to pivot about its pivotal fulcrum 116 serving as a rotary support provided on the drum 18 and protrude from the storage 112 out of the outer peripheral surface 82 of the drum 18 so as to mate part of the notch 102 of the movable guide 32, thereby inhibiting the rotation of the drum 18. In the present embodiment, the mating piece 114 has a contact surface 118 which has a size capable of being seated within the notch 102 of the movable guide 32 and contacting the part of the notch 102 of the movable guide 32 on the side of the direction 74 of rewinding the tapes. When the tapes 24 and 26 are completely rewound, the contact surface 118 contacts the part of the notch 102, thereby inhibiting the rotation of the drum 18. The contact surface 118 needs to have a shape appropriate for the notch 102 contacting thereto and thus is planar in the present embodiment. In order for the contact surface 118 and the notch 102 to prevent from being slipped against each other when the contact surface 118 contacts the notch 102, the contact surface 118 and the notch 102 contacting thereto may be provided with an anti-slip finish or the like.

In order to cause the mating piece 114 to protrude from the storage 112 out of the outer peripheral surface 82 of the drum 18, the mating piece 114 receives a biasing force by a spring member, not shown, such as a torsion spring, a coil spring or a leaf spring. Such a spring member may be provided at any location, for example, at the rotary support 116 or the storage 112.

The rotary support 116 of the mating piece 114 is provided at one edge of the storage 112 formed on the drum 18 in the tape wind-up direction 72. Therefore, the rotation direction 120 for seating the mating piece 114 about the rotary support 116 in the storage 112 comes to be the same as the tape wind-up direction 72 of the drum 18, and thus the mating piece 114 is seated in the storage 112 while the tapes 24 and 26 are wound on the drum 18. By contrast, when the drum 18 is rotated in the direction of rewinding the tapes 74 and the tapes 24 and 26 are completely rewound from the drum 18, i.e. when no tapes 24 and 26 is wound on the drum 18, the mating piece 114 is pushed out by the biasing force of the spring member to protrude out of the outer peripheral surface 82 of the drum 18. At the time, the mating piece 114 preferably protrudes out of the outer peripheral surface 82 of the drum 18 to the extent of exceeding the thicknesses of the tapes 24 and 26 exhibited when the tapes 24 and 26 are wound on the drum 18 as much as possible.

Figure 6:
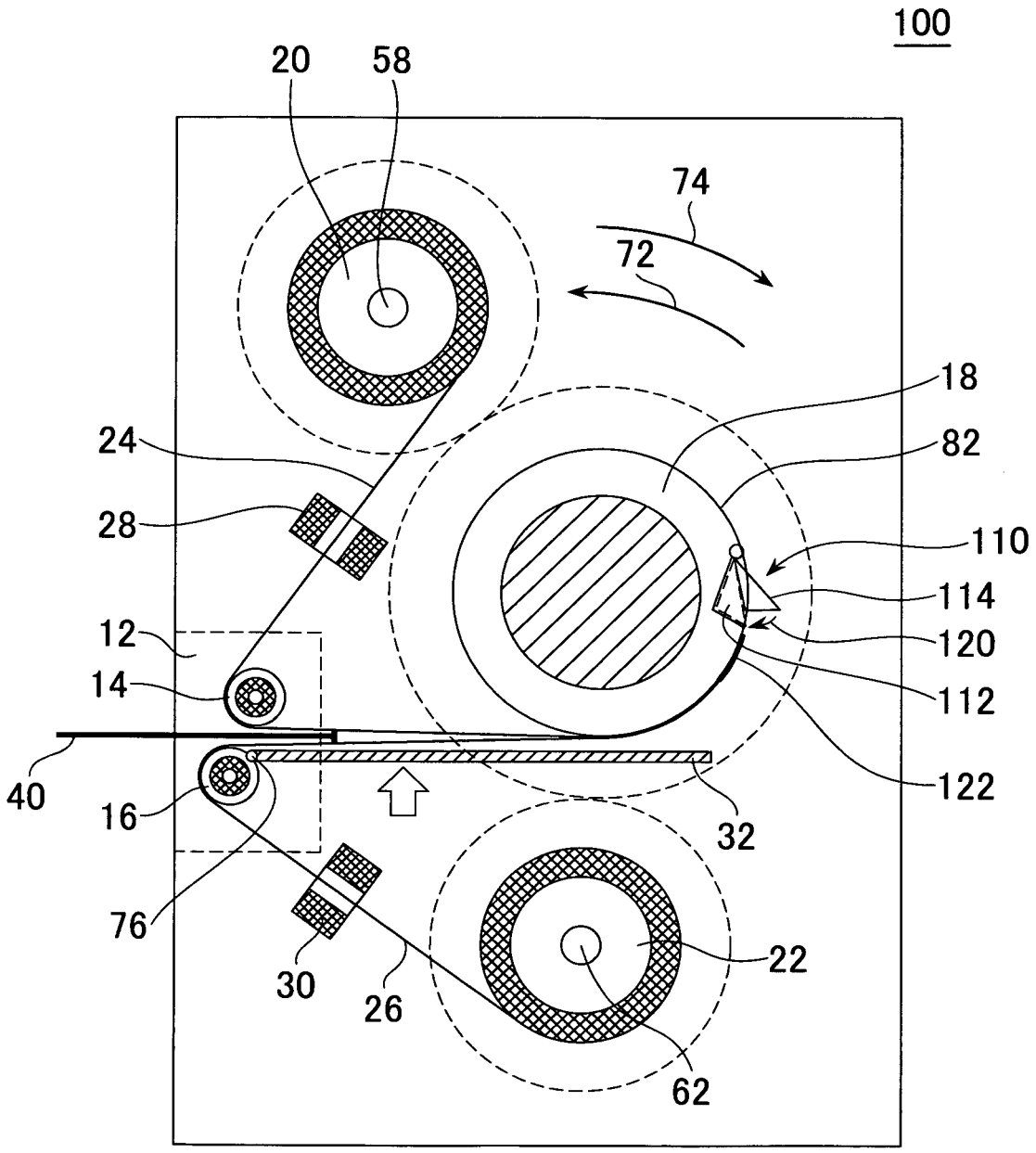
FIG. 6 is a schematic side view showing the main part of an alternative embodiment of the medium storing and advancing apparatus according to the present invention.

In an example illustrated in FIG. 6, the drum 18 has its surface 82 on which a tape bonding section 122 is formed to which one end portion of each of the tapes 24 and 26 is attached. In the present embodiment, the tape bonding section 122 is arranged adjacent to the storage 122 and the mating piece 114, and behind the storage 112 and the mating piece 144, viewing from the tape wind-up direction 72, namely preceding in the direction of rewinding the tapes 74 with respect to the storage 112 and the mating piece 114. The tapes 24 and 26 are attached to the tape bonding section 122. As described above, since the bonding section 122 is positioned behind the storage 112 and the mating piece 114, viewing from the tape wind-up direction 72, if the drum 18 is rotated once in the tape wind-up direction 72 of winding up the tapes 24 and 26 so that the tapes 24 and 26 pass through over the mating piece 114, then the mating piece 114 is seated in the storage 112 by means of the tapes 24 and 26. Therefore, the limiter 110 is closed by the tapes 24 and 26.

Figure 7:
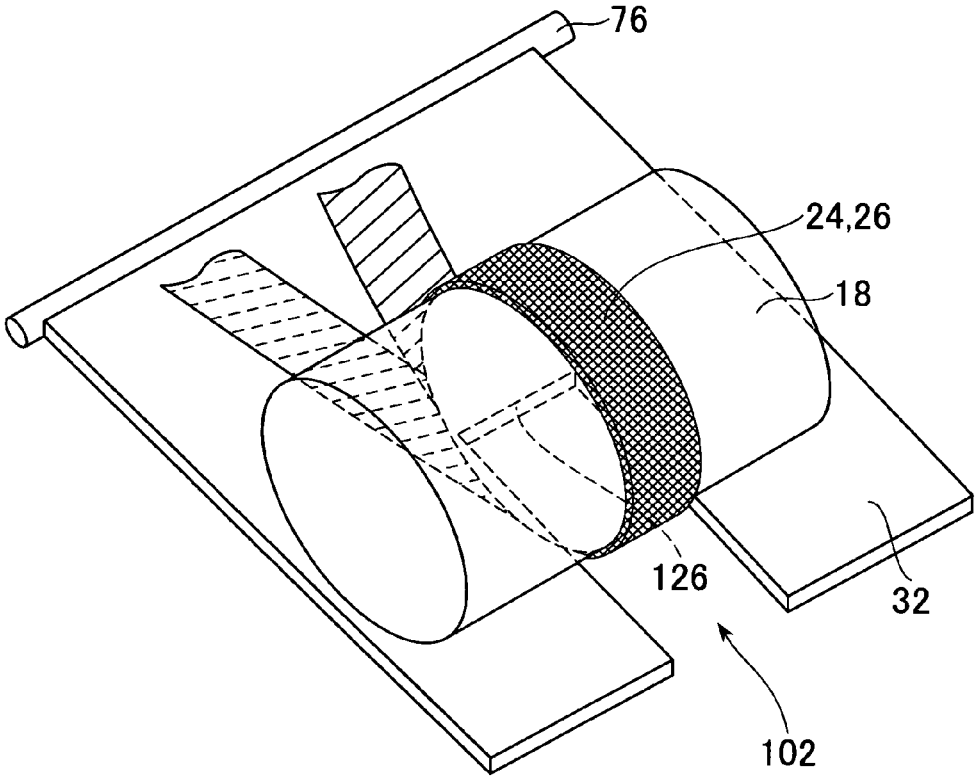
FIG. 7 is an explanatory diagram schematically showing a positional relationship between the drum and the movable guide in the embodiment of FIG. 6.

As is illustrated in FIG. 7, the movable guide 32 is partially cut out to form the notch 102. More specifically, in the present embodiment, the movable guide 32 is cut out with its width corresponding to that of the tapes 24 and 26 from the center portion of one edge of the movable guide 32 opposite to the rotary shaft 76 toward the center of the movable guide 32. The notch 102 is formed by partially cutting the movable guide 32 in order that the tapes wound on the drum 18 are prevented from contacting the movable guide 32 when the tapes pass through the movable guide 32. One 126 of the surfaces forming the notch 102 which is horizontal to the rotary shaft abuts on a contact surface 118 of the mating piece 114, thereby inhibiting the rotation of the drum 18.

Figure 9:
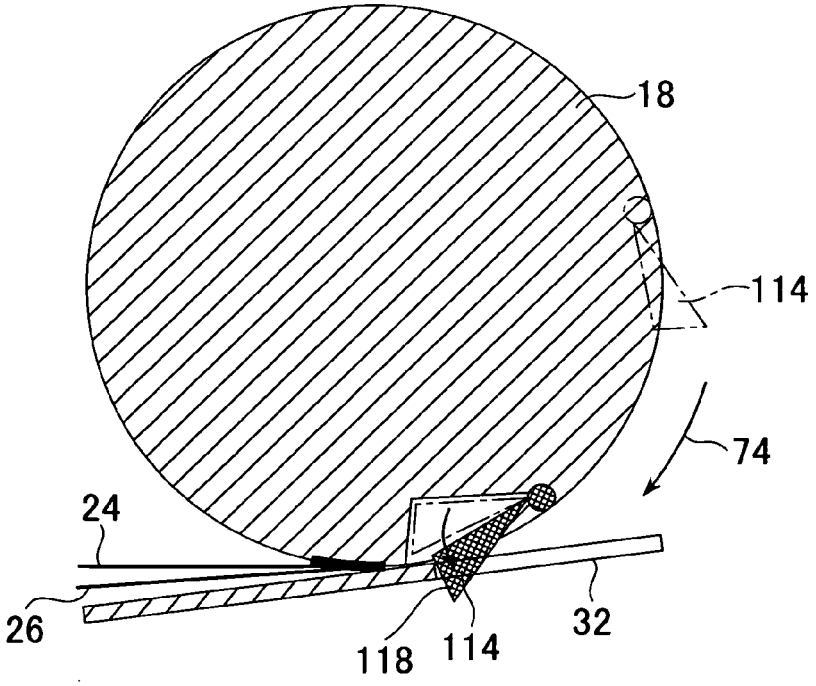
FIG. 9 is a schematic side view showing how the rotation of the drum is inhibited by an inhibiting mechanism in the embodiment of FIG. 6.
Figure 10:
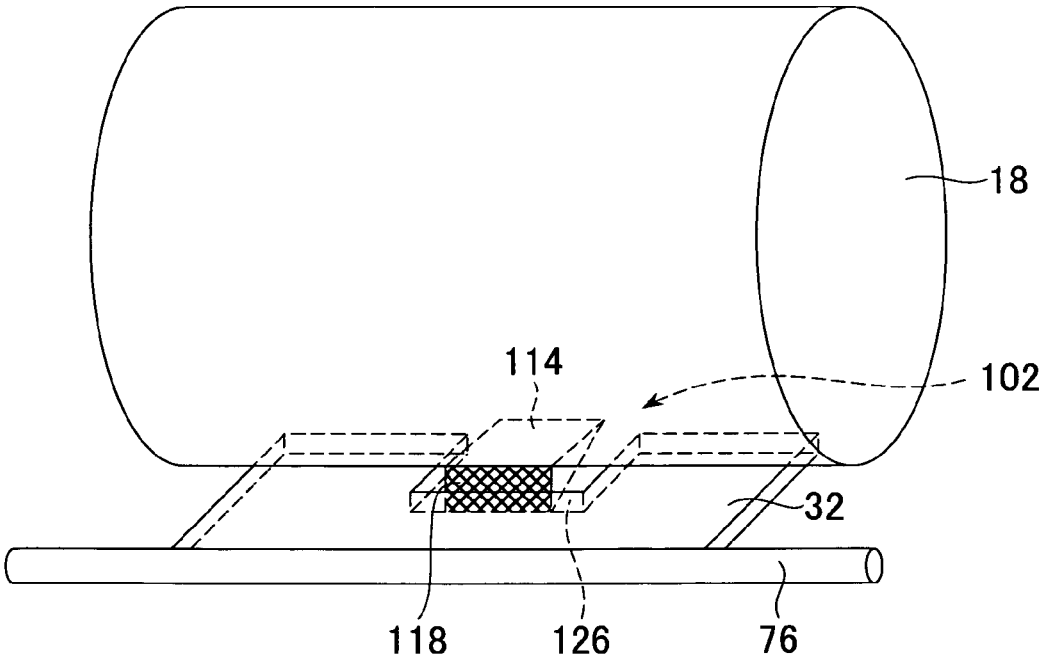
FIG. 10 is a schematic side view showing how the rotation of the drum is inhibited by the inhibiting mechanism in the embodiment of FIG. 6.

It will be described in detail with reference to FIGS. 8, 9 and 10 how to inhibit the rotation of the drum 18 caused by the abutment of the notch 102 on the mating piece 11. In FIGS. 8, 9 and 10 exemplify a rewinding operation that the bill causing the jammed storage is removed to the outside. If the bill 40, while being stored or fed out, is wound on the drum 18 and folded to cause the operation failure of the drum 18, i.e. so-called jammed storage, the person in charge of the medium storing and advancing apparatus 10 turns the operation knob 52 of the apparatus 10 in the direction of rewinding the tapes in order to remove the bill having caused the jammed storage to the outside. Accordingly, when the operation knob 20 is rotated in the direction of rewinding the tapes, the drum shaft 46 rotates in the direction of rewinding the tapes and thereby the drum 18 rotates in the direction of rewinding the tapes 74 to allow the tapes 24 and 26 wound on the drum 18 to be rewound.

Since the drum shaft 46 rotates in the direction of rewinding the tapes while the drum 18 rotates, the rotation is transmitted to the reel gears 64 and 66 from the drum gears 54 mounted to the drum shaft 46, and the reel shafts 58 and 62 are thereby rotated in the direction of winding up the tapes 24 and 26. Accordingly, the reels 20 and 22 are rotated in the tape wind-up direction to wind up each of the tapes 24 and 26 rewound from the drum 18. As described above, the rotation of the operation knob 52 causes the bill having caused the jammed storage to be fed out together with the tapes 24 and 26 rewound from the drum 18, thereby being discharged from the bill insertion and discharge slot 12.

Thereafter, if the person in charge further continues to rotate the operation knob 52, the tapes 24 and 26 come to be unexistent on the mating piece 114 as illustrated in FIG. 8, so that the mating piece 114 is opened from the storage 112 to protrude to the outside of the drum 18.

In the state that the mating piece 114 protrudes as described above, if the drum 18 is further rotated in the direction of rewinding the tapes 74 in a manner as illustrated in FIG. 9, as illustrated in FIG. 10, part of the notch 102 formed on the movable guide 32, i.e. a surface 126 of the notch 102 in the example shown in FIG. 10, is brought into contact with the mating piece 114, so that the rotation of the drum 18 can be inhibited. Accordingly, the tapes can be prevented from being destroyed and the medium storing and feeding apparatus can be minimized in size.

As described above, in the instant alternative embodiment, the limiter 110 and the notch 102 provided in the movable guide 32 form an inhibiting mechanism that prevents the drum 18 from being continuously rotated in the direction of rewinding the tapes 74 after the tapes 24 and 26 are completely rewound. As a matter of course, such an inhibiting mechanism is applicable to a case where the drum 18 is rotated via the operation knob 52 or a case where the drum 18 is rotated through a drive motor or the like, not shown, thus being able to inhibit the rotation of the drum 18.

The inhibiting mechanism of the present invention as described above can be applied to any configuration of the medium storing and feeding apparatus. For example, the inhibiting mechanism of the present invention may be applied to a medium storing and feeding apparatus having a single tape and a single reel. Furthermore, the inhibiting mechanism of the present invention may be applied to the reels, for example.

The entire disclosure of Japanese patent application No. 2008-165122 filed on Jun. 24, 2008, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

The invention claimed is:

1. A medium storing and advancing apparatus comprising:

a reel which supplies or winds up tapes;

a drum which winds up the tapes supplied from said reel or rewinding the wound tapes to supply the tapes to said reel; and a guide for guiding the medium to said drum or said reel while said guide contacts the medium, wherein a medium is sandwiched between the tapes wound up by said drum to store the medium, or the medium sandwiched by the tapes and stored is fed out by rewinding said drum, said guide including a protruding member which contacts an outer peripheral surface of said drum when the tapes are completely rewound from said drum, said drum having a recess on the outer peripheral surface for engaging with said protruding member, said recess being positioned preceding in a tape wind-up direction with respect to a location where one end of each of the tapes is attached, viewing from the tape wind-up direction, and said recess including a vertical surface, whereby, when said drum completely rewinds the tapes, said protruding member falls onto the recess so that said protruding member impinges on the vertical surface to enter into the recess to arrest further rotational motion of said drum in a direction of rewinding the tapes.

2. The medium storing and advancing apparatus in accordance with claim 1, wherein said guide has a spring property which depresses said protruding member against a position where the tapes are wound on said drum to cause said protruding member to enter into the recess.

3. The medium storing and advancing apparatus in accordance with claim 1, wherein said protruding member is a roller provided on said guide.

4. The medium storing and advancing apparatus in accordance with claim 1, wherein the vertical surface is positioned preceding in a tape wind-up direction with respect to a location where one end of each of the tapes is attached, viewing from the tape wind-up direction.

5. The medium storing and advancing apparatus in accordance with claim 4, wherein the vertical surface has a size such that said protruding member does not climb over the recess.

6. A medium storing and advancing apparatus comprising:

a reel which supplies or winds up tapes;

a drum which winds up the tapes supplied from said reel or rewinds the wound tapes to supply the tapes to said reel; and a guide for guiding the medium to said drum or said reel while said guide contacts the medium, wherein a medium is sandwiched between the tapes wound up by said drum to store the medium, or the medium sandwiched by the tapes and stored is fed out by rewinding said drum, said guide having a notch formed at a position where the tapes wound on said drum pass through said guide, said notch including a notch surface, said drum including a mating piece to be mated with the notch, said mating piece including a contact surface and being provided on the outer peripheral surface of said drum at a position advanced in a tape wind-up direction from a position where one end of each of the tapes is attached, viewing from the tape wind-up direction, whereby, when said drum completely rewinds the tapes, the notch surface contacts the contact surface of said mating piece to arrest further rotational motion of said drum in a direction of rewinding the tapes.

7. The medium storing and advancing apparatus in accordance with claim 6, wherein said mating piece is a protrusion which protrudes out of an outer peripheral surface of said drum, said drum further including a storage recess for allowing said mating piece to be seated therein, and a spring member for causing said mating piece to protrude out of the storage recess, said mating piece being seated in the storage recess when the tapes are wound on said drum.

8. A medium storing and advancing apparatus comprising:

a reel which supplies or winds up a single tape;

a drum which winds up the tape supplied from said reel or rewinding the wound tape to supply the tape to said reel; and a guide for guiding the medium to said drum or said reel while said guide contacts the medium, wherein a medium is carried on the tape wound up by said drum to store the medium, or the medium carried on the tape and stored is fed out by rewinding said drum, said guide including a protruding member which contacts an outer peripheral surface of said drum when the tape is completely rewound from said drum, said drum having a recess on the outer peripheral surface for engaging with said protruding member, said recess being positioned preceding in a tape wind-up direction with respect to a location where one end of each of the tapes is attached, viewing from the tape wind-up direction, and said recess including a vertical surface, whereby, when said drum completely rewinds the tapes, said protruding member falls onto the recess so that said protruding member impinges on the vertical surface to enter into the recess to arrest further rotational motion of said drum in a direction of rewinding the tapes.

9. The medium storing and advancing apparatus in accordance with claim 8, wherein said guide has a spring property which depresses said protruding member against a position where the tape is wound on said drum to cause said protruding member to enter into the recess.

10. The medium storing and advancing apparatus in accordance with claim 8, wherein said protruding member is a roller provided on said guide.

11. The medium storing and advancing apparatus in accordance with claim 8, wherein vertical surface is positioned preceding in a tape wind-up direction with respect to a location where one end of each of the tapes is attached, viewing from the tape wind-up direction.

12. The medium storing and advancing apparatus in accordance with claim 11, wherein the vertical surface has a size such that said protruding member does not climb over the recess.

13. A medium storing and advancing apparatus comprising:

a reel which supplies or winds up a single tape;

a drum which winds up the tape supplied from said reel or rewinds the wound tape to supply the tape to said reel; and a guide for guiding the medium to said drum or said reel while said guide contacts the medium, wherein a medium is carried on the tape wound up by said drum to store the medium, or the medium carried on the tape and stored is fed out by rewinding said drum, said guide having a notch formed at a position where the tape wound on said drum pass through said guide, said notch including a notch surface, said drum including a mating piece to be mated with the notch, said drum further including a storage recess to allow said mating piece to be received thereinto, said mating piece including a contact surface and being provided on the outer peripheral surface of said drum at a position advanced in a tape wind-up direction from a position where one end of each of the tapes is attached, viewing from the tape wind-up direction, whereby, when said drum completely rewinds the tape, said mating piece protrudes from the storage recess so that the notch surface contacts the contact surface of said mating piece to arrest further rotational motion of said drum in a direction of rewinding the tape.

14. The medium storing and advancing apparatus in accordance with claim 13, wherein said mating piece is a protrusion which protrudes out of an outer peripheral surface of said drum, said drum further including a spring member for causing said mating piece to protrude out of the storage recess, said mating piece being seated in the storage recess when the tape is wound on said drum.

* * * * *